United States Patent [19]

Morgan

[11] 4,301,919

[45] Nov. 24, 1981

[54] MAIL RETURN KIT

[76] Inventor: Webster Morgan, 369 Highland Ave., Rochester, N.Y. 14620

[21] Appl. No.: 854,296

[22] Filed: Nov. 23, 1977

[51] Int. Cl.[3] ..... B65D 73/00

[52] U.S. Cl. ..... 206/223; 206/460; 206/487; 229/92.8

[58] Field of Search ..... 206/223, 575, 460, 487; 229/92, 92.8; 40/2 B, 10 D, 359, 360; 150/35, 41

[56] References Cited

U.S. PATENT DOCUMENTS

| | | | |
|---|---|---|---|
| 209,581 | 11/1878 | Oliver et al. | 40/2 B |
| 1,141,172 | 6/1915 | Clark | 229/92.8 |
| 1,912,492 | 6/1933 | McKibbin | 206/487 |
| 2,805,816 | 9/1957 | Morgan | 229/92.8 |
| 3,334,736 | 8/1967 | Cole et al. | 206/460 |
| 3,347,361 | 10/1967 | Lindeke | 206/460 |
| 3,411,978 | 11/1968 | Frohbach et al. | 206/460 |
| 3,958,690 | 5/1976 | Gee, Sr. | 206/38 |
| 4,055,249 | 10/1977 | Kojima | 206/460 |

*Primary Examiner*—Herbert F. Ross
*Attorney, Agent, or Firm*—Martin LuKacher

[57] ABSTRACT

A kit for returning lost or stolen wallets and like articles is described. The kit consists of a card, a stamp and a mailing label mounted in over-lapping relationship on one side of the card in slots in the card. Strips of pressure sensitive tape are mounted on the opposite side of the card. Indicia containing instructions for use of the stamp, label and tape are located on the same side of the card as the label. A transparent holder receives the card. The kit is kept in the wallet in the hope that the finder will return the wallet by using the kit which is available therein.

10 Claims, 2 Drawing Figures

MAIL RETURN KIT

The present invention relates to a kit for the return of wallets and similar articles through the mails.

The kit enables anyone who finds a lost or stolen wallet to very easily return it to the owner at no expense to the finder and without requiring the finder to identify himself.

Wallets contain many personal items which are of value only to the owner. Fearful of being accused of misappropriation, finders of lost or stolen wallets seldom bother to attempt to return them to the owner. Often times, the return of a stolen or lost wallet can inconvenience the finder because of the need to make contact with the owner who may reside in a different neighborhood or even out of the local area, say in a different state. Also there may be a reluctance on the part of the finder to cooperate with the authorities who may require reports and records of the incident.

It is an object of this invention to provide a kit for use by the finder of lost or stolen articles, such as wallets, which provides him with all of the facilities needed to return the wallet with a minimum of inconvenience and bother.

It is another object of the invention to provide a kit which is compact and fits in the wallet just like any identification or credit card and which makes available to the finder the wherewith all for packing and mailing the wallet to the owner.

It is a further object of the invention to provide any lost wallet mail return kit by means of which the factors which militate against the return of lost and stolen wallets are eliminated.

Briefly described a kit for returning articles, such as wallets through the mails which embodies the invention utilizes a card, a postage stamp, a mailing label, and adhesive tape. The card has a first plurality of slots which receive the corners of the stamp when the stamp is mounted on one side of the card. A second plurality of slots, which may be offset from the first plurality of slots on opposite sides thereof, receives the opposite ends of the label with the label overlying the stamp. The tape, several strips of which may be provided, is mounted, say on a non-stick covering, on the opposite side of the card. The card with the stamp, label and tape mounted thereon is received in a transparent holder such as a folder of celluloid or acetate, or a sleeve of polyethylene. Indicia on the same side of the card as the stamp and label provides instructions to the finder to package the wallet with the tape, attach the stamp and label and place the package in the mails. The entire kit is of a size which fits into the wallet.

The foregoing and other object features and advantages of the invention will become more apparent from a reading of the following description in connection with the accompanying drawing in which.

Figure 2:
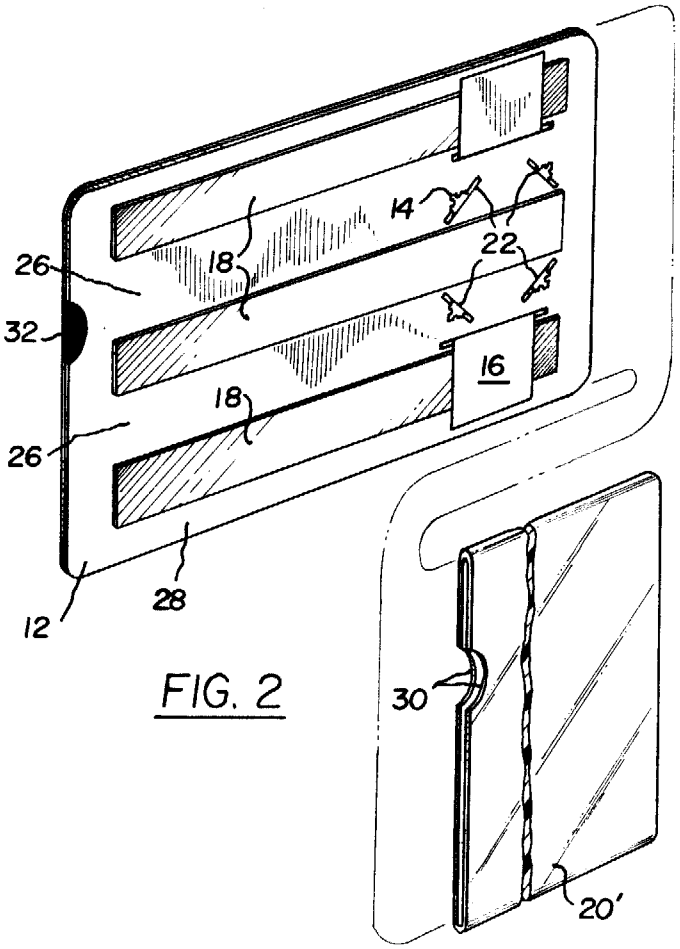
FIG. 2 is a perspective view of the kit from the rear.
Figure 1:
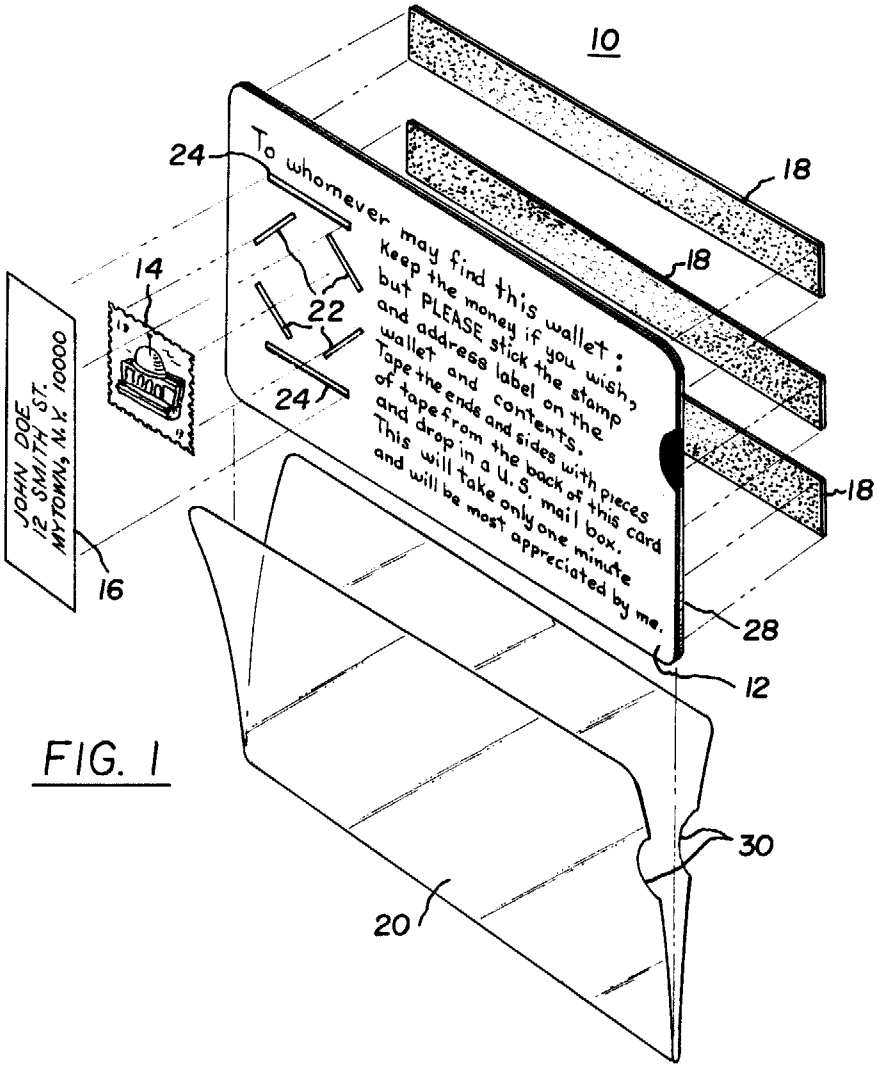
FIG. 1 is an exploded view of a kit embodying the invention.

Referring to the drawings there is shown a lost or stolen wallet mail return kit 10 which contains a card 12 of cardboard, stiff paper or plastic. This card is of a compact size which conveniently fits into a wallet (e.g., 2½ inches by 3⅜ inches, or 2½ inches by 3¾ inches). The other components of the kit 10 are: a postage stamp 14 of suitable denomination to insure the return of the wallet by first class mail (e.g. fifty cent denomination); a mailing label 16 which may have adhesive on the back thereof like that on the back of the stamp 14; strips of pressure sensitive tape 18; and a transparent container; shown as a celluloid or acetate folder 20 (FIG. 1) and as a polyethylene or other plastic sleeve 20' (FIG. 2).

The card 12 has four slots 22 which receive the corners of the stamp 14 when the stamp is mounted on the front side of the card 12. Two slots 24 above and below the stamp slots 22 receive the ends of the label 16. The label 16 overlaps the stamp 14 but leaves the edges of the stamp visible. The slots 22 and 24 fall within the gaps 26 (FIG. 2) between the strips of tape 18.

Indicia in the form of printed instructions for the use of the kit are provided on the front side of the card 12. The slots 22 and 24, and therefore the stamp 14 and label 16, are located offset near one edge of the card. The indicia are located between the region of the slots' 22 and 24 and the opposite edge of the card.

In the event that the card 12 is of cardboard or paper or some other substance from which the tape 18 cannot readily be peeled, a non-stick sheet 28 may be attached as by glue or laminating to the rear side of the card.

The folder 20 may have notches 30 so as to permit the card to be grasped by the fingers, as at 32, for ease of removal from the folder. The folder keeps the card 12 rigid and protects the kit, preventing the label 16 and stamp 14 from loosening themselves from their slots 22 and 24. A similar purpose is served by the sleeve 20'. The indicia depicted on the drawing is an example of suitable instructions for and the manner of use of the kit 10.

Variations and modifications of the herein described kit, within the scope of the invention, will undoubtedly suggest themselves. The description should therefore be taken as illustrative and not limiting. For example, should postal regulations permit, the postage stamp may be replaced by a sticker or other label having indicia providing a statement that return postage is guaranteed. Alternatively the return postage guarantee statement may be contained on the mailing label. Accordingly the term "postage stamp" should be taken to include such a sticker or other label.

What is claimed is:

1. A kit for returning an article such as a wallet, through the mails, said kit comprising a card of a size which fits into said article, a mailing label, adhesive tape, said card having means for removably receiving the said mailing label to mount said mailing label on one side of card, said tape being mounted on the side of said card opposite from said one side, and said card containing indicia providing instructions for securing the article with said tape, attaching said label to said article and mailing said article.

2. The invention as set forth in claim 1 wherein said means for receiving said label consists of a plurality of slots which receive the opposite ends of said label when said label is mounted on said one side of said card.

3. The invention as set forth in claim 2 wherein said kit further comprises a postage stamp, said card having a second plurality of slots which receive the corners of said stamp when said stamp is mounted on one side of said card, said first named plurality of slots which receive said mailing label being spaced on opposite sides of said of second plurality of slots such that said label overlies said stamp when said label is mounted on said one side of said card, and said indicia also providing instructions for attaching said stamp to said article.

4. The invention as set forth in claim 3 including a transparent holder in which said card with said stamp, label and tape mounted thereon are contained.

5. The invention as set forth in claim 4 wherein said holder is a folder of stiff material of the class including celluloid and acetate.

6. The invention as set forth in claim 5 wherein said folder has a notch in one edge thereof providing for finger grasping of said card.

7. The invention as set forth in claim 4 wherein said holder is a sleeve which is closed except along one edge into which said card is inserted and from which said card is removed.

8. The invention as set forth in claim 3 wherein said tape is self adhesing pressure sensitive tape and wherein a layer of non-sticking backing material is attached to said opposite side of said card.

9. The invention as set forth in claim 8 wherein plurality of strips of said tape are mounted on said opposite side with gaps there between, said slots being disposed in said gaps.

10. The invention as set forth in claim 3 wherein said slots are located offset from and adjacent one edge of said card and said indicia are located between said slots and the opposite edge of said card.

* * * * *